US011220927B2

(12) United States Patent
Laroche et al.

(10) Patent No.: US 11,220,927 B2
(45) Date of Patent: Jan. 11, 2022

(54) ASSEMBLY FOR A TURBOMACHINE

(71) Applicant: Safran Aircraft Engines, Paris (FR)

(72) Inventors: Clément Raphaël Laroche, Moissy-Cramayel (FR); Ludovic Gallego, Moissy-Cramayel (FR); Damien Greuet, Moissy-Cramayel (FR); Eric Abadie, Moissy-Cramayel (FR)

(73) Assignee: Safran Aircraft Engines, Paris (FR)

( * ) Notice: Subject to any disclaimer, the term of this patent is extended or adjusted under 35 U.S.C. 154(b) by 22 days.

(21) Appl. No.: 16/819,631

(22) Filed: Mar. 16, 2020

(65) Prior Publication Data

US 2020/0300112 A1 Sep. 24, 2020

(30) Foreign Application Priority Data

Mar. 18, 2019 (FR) ..... 1902777

(51) Int. Cl.
*F01D 25/00* (2006.01)
*F01D 25/12* (2006.01)

(52) U.S. Cl.
CPC ..... *F01D 25/007* (2013.01); *F01D 25/005* (2013.01); *F01D 25/125* (2013.01)

(58) Field of Classification Search
CPC .... F01D 25/005; F01D 25/007; F01D 25/125; F01D 25/18; F05D 2240/61
See application file for complete search history.

(56) References Cited

U.S. PATENT DOCUMENTS

| | | | | |
|---|---|---|---|---|
| 7,004,725 | B2 * | 2/2006 | Vache | F02C 7/00 415/111 |
| 7,384,075 | B2 * | 6/2008 | Ress, Jr. | F01D 11/00 285/333 |
| 8,209,834 | B2 | 7/2012 | Mons et al. | |
| 9,322,293 | B2 * | 4/2016 | Brault | F16L 37/14 |
| 10,302,016 | B2 * | 5/2019 | Durand | F01D 5/026 |
| 10,557,351 | B2 * | 2/2020 | Amano | F01D 5/02 |
| 10,940,938 | B2 * | 3/2021 | Servant | F01D 25/20 |
| 2017/0218766 | A1 | 8/2017 | Amano | |
| 2018/0128180 | A1 | 5/2018 | Durand et al. | |
| 2021/0087947 | A1 * | 3/2021 | Brault | F16J 15/3292 |

FOREIGN PATENT DOCUMENTS

EP 3 176 407 A1 6/2017

* cited by examiner

*Primary Examiner* — Jesse S Bogue
(74) *Attorney, Agent, or Firm* — Blank Rome LLP

(57) ABSTRACT

An assembly comprising a vent tube intended to be mounted inside a turbine shaft of a turbomachine. The vent tube has a radially inner annular part from which at least one annular centering part extends radially outwards. The centering part has a groove and a sealing part of a sealing member is mounted in the groove. The sealing part is designed to come into sealing abutment against an inner surface of the turbine shaft. The sealing member has a protective part covering at least one area of the centering part situated upstream and/or downstream of the groove.

8 Claims, 3 Drawing Sheets

ASSEMBLY FOR A TURBOMACHINE

CROSS-REFERENCE TO RELATED APPLICATION

This application claims the benefit of French Patent Application No. 1902777, filed on Mar. 18, 2019, the contents of which is incorporated by reference herein.

TECHNICAL FIELD OF THE INVENTION

The present invention relates to an assembly for a turbomachine, such as, for instance, an aircraft turbojet engine or a turboprop engine.

PRIOR ART

A turbomachine conventionally comprises, in the downstream direction with respect to the direction of gas flow within the turbomachine, a blower, a low-pressure compressor, a high-pressure compressor, a combustion chamber, a high-pressure turbine, a low-pressure turbine, and an exhaust nozzle.

The low-pressure turbine has a plurality of bladed impellers mounted on a rotor shaft, called the low-pressure shaft or low-pressure turbine shaft, which is hollow and extends upstream to the blower, whereby the rotation of the shaft caused by the low-pressure turbine causes the blower to rotate.

The turbomachine also includes certain components that must be lubricated by oil injection, such as rolling bearings that support the low-pressure shaft in rotation. These components are also permanently cooled by a flow of gas which is charged with oil as it flows through the components. To discharge this oily gas stream, the turbomachine includes a vent tube 1, also commonly referred to as a "CVT" tube, extending coaxially inside the low-pressure turbine shaft 2, as shown in FIGS. 1 and 2. This tube 1 operates as an outlet for the oily gases, and prevents these gases from coming into contact with the low-pressure turbine shaft 2, whose high temperature would cause the oil in the gas flow to coke and the turbomachine to deteriorate.

The vent tube 1 has a radially inner annular part 3 from which centering annular parts 4 extend radially outwards. Each centering part 4 comprising a groove 5 opening radially outwards, in which an annular seal 6 capable of ensuring sealing between the centering part 4 and the inner surface 7 of the low-pressure turbine shaft 2 is mounted.

The vent pipe 1 can be made in two parts, namely an upstream part 1*a* and a downstream part 1*b*, the downstream end of the upstream part 1*a* being mounted in the upstream end of the downstream part 1*b*. The downstream end of the upstream part 1*a* of the vent tube 1 then also has a centering part 4 comprising a groove 5 equipped with a seal 6 capable of ensuring sealing with the internal surface 8 of the downstream part 1*b* of the vent tube 1.

When mounting each part 1*a*, 1*b* of the vent pipe 1 into the low-pressure turbine shaft 2, the centering parts 4 tend to damage, in particular, the paint layer on the inner surface 7 of the low-pressure turbine shaft 2. As the paint layer provides protection against corrosion, such damage affects the service life of the shaft 2.

In order to limit such damage, tools can be provided to improve the positioning of the vent tube 1 when it is inserted axially into the low-pressure turbine shaft 2. In view of the manufacturing and assembly tolerances of the tools and the very small clearances required for assembly between the vent tube 1 and the low-pressure turbine shaft 2, it is in reality not possible to completely avoid such damage.

DISCLOSURE OF THE INVENTION

The invention aims to remedy such drawback in a simple, reliable and inexpensive way.

For this purpose, the invention relates to an assembly comprising a vent tube intended to be mounted inside a turbine shaft of a turbomachine, comprising a radially inner annular part from which at least one annular centering part extends radially outwards, said centering part comprising a groove, characterised in that the assembly comprises a sealing member comprising a sealing part mounted in the groove of the centering part, the sealing part being intended to bear sealingly against an inner surface of the turbine shaft, the sealing member further comprising a protective part covering one area of the centering part located upstream and/or downstream of the groove. The terms upstream and downstream are defined relative to the gas flow through the vent tube and the turbomachine. Besides, the terms axial, radial and circumferential are defined relative to the axis of the vent tube, which coincides with the axis of the turbomachine.

The protective part prevents damage to the turbine shaft when inserting the vent tube by covering the areas of the centering part which may protrude and damage the inner surface of the turbine shaft during assembling operations. The areas to be covered may depend, among other things, on the direction of mounting. It is necessary to cover the area of the centering part which will be exposed first when the vent tube is mounted axially in the turbine shaft.

The protective part and the sealing part can be formed in one piece.

Such characteristic makes it possible to facilitate the assembling of the sealing member on the vent tube.

The protective part can be formed by a ring separate from the sealing part. The sealing part can be formed by an annular seal. The ring forming the protective part can be housed in a housing which is complementary in shape to the centering part.

The protective part and the sealing part can be made of the same or different material(s). In particular, the sealing part can be made of a material with a lower hardness than the protective part.

The sealing element may comprise an upstream protective part covering an area of the centering part located upstream of the groove and a downstream protective part covering an area of the centering part located downstream of the groove.

The protective part of the sealing member may have an upstream end and/or a downstream end comprising at least one hook engaging in a recessed area of the upstream end and/or in a recessed area of the downstream end of the centering part.

The protective part of the sealing member may comprise a cylindrical part connecting the sealing part to the end fitted with the hook.

The sealing part may have an annular bead protruding radially outwards from the cylindrical part. The connecting area between the hook and the cylindrical part may have a rounded shape.

The radius of curvature is, for example, between 0.5 and 3 times the diameter of said cylindrical part, e.g. between 0.05 and 2 mm.

The hook may be annular and may have a truncated conical part suitable for resting against a truncated conical surface of the recessed area.

The invention furthermore concerns a turbomachine comprising a turbine shaft and an assembly of the above-mentioned type mounted in the turbine shaft.

The turbine is for example a low pressure turbine.

DETAILED DESCRIPTION OF THE INVENTION

Figure 1:
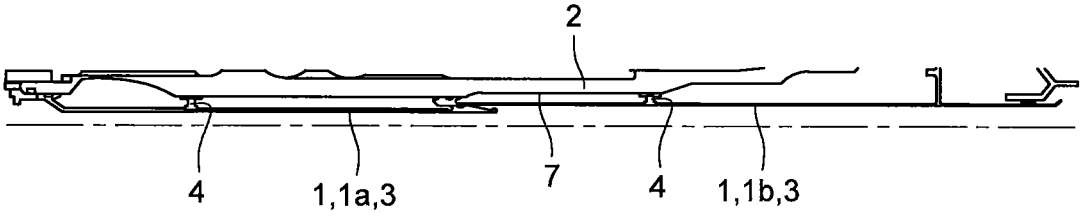
FIG. 1 is a half-view in axial section of a low-pressure turbine shaft and a vent tube according to the prior art.
Figure 2:
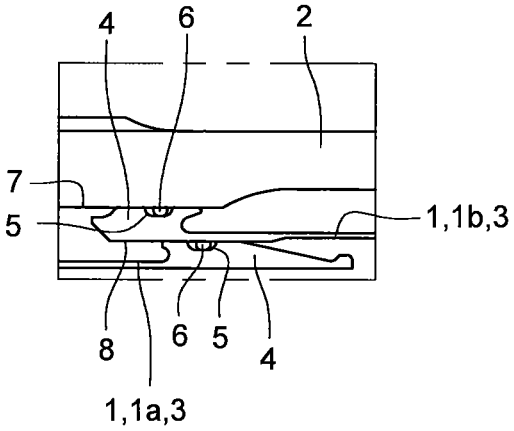
FIG. 2 is a detailed view of a part of FIG. 1.
Figure 3:
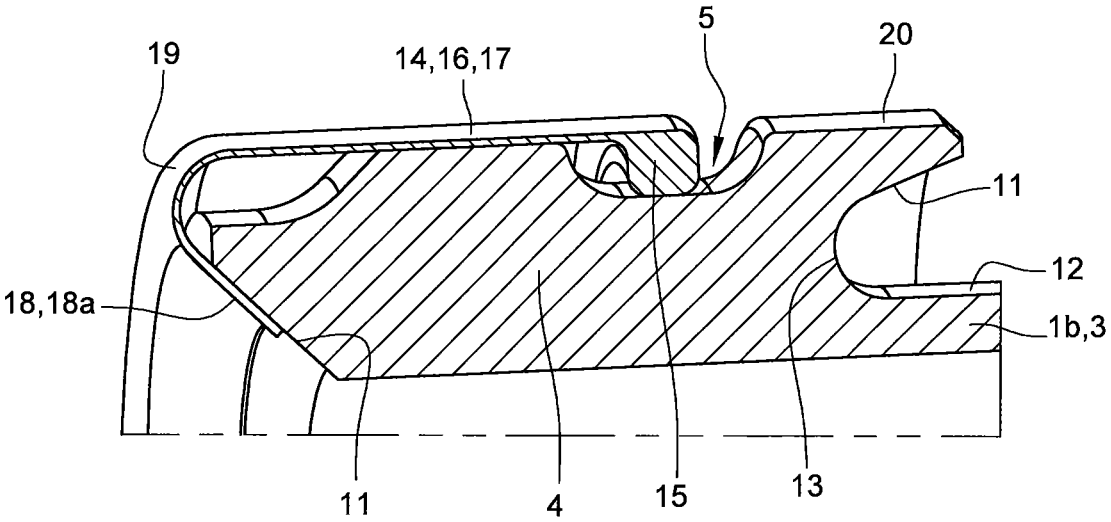
FIG. 3 is a cross-sectional view in perspective of a portion of an assembly according to one embodiment of the invention.
Figure 4:
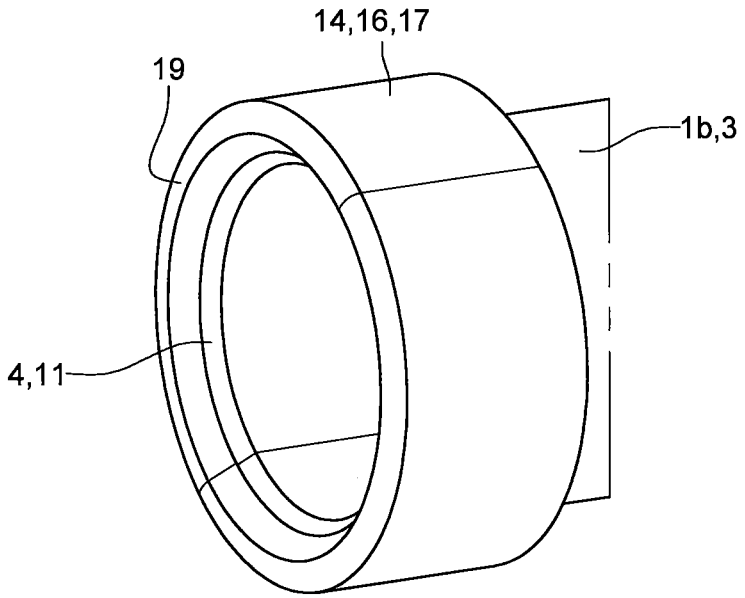
FIG. 4 is a perspective view of a part of the assembly of FIG. 3.

FIGS. 3 to 4 illustrate a part of an assembly according to a first embodiment of the invention. The assembly comprises a vent tube 1 or CVT, formed as previously of an upstream part 1*a* and a downstream part 1*b*. FIGS. 3 and 4 show the upstream end of the downstream part 1*b* of the vent tube 1. Of course, the invention is not limited to this particular area of the vent tube 1, nor to a vent tube 1 having an upstream part 1*a* and a downstream part 1*b*.

The vent tube 1 has a cylindrical part 3 from which centering parts 4 extend radially inwards. Each centering part 4 has an axially central annular groove 5 whose axial ends have fillets 5*a* or are rounded. The groove 5 opens radially to the outside.

The upstream end of the centering part 4 shown in FIG. 3 also has a recess 9 opening radially outwards and axially in the upstream direction. The surface of the recess 9 is concave and rounded.

The upstream and downstream ends of the centering part 4 shown in FIG. 3 have recessed areas 10, said recessed areas being delimited by frustoconical surfaces 11. Each frustoconical surface 11 tapers axially towards the opposite end of the centering part 4. The frustoconical surface 11 faces radially inwards.

The recessed area 10 of the downstream end of the centering part 4 visible in FIG. 3 is delimited by the corresponding frustoconical surface 11, by the radially outer surface 12 of the cylindrical part 3 of the tube 1 and by a curved connecting area 13 connecting said frustoconical surface 11 and said cylindrical outer surface 12.

A sealing element 14 is mounted on each centering part 4. The sealing member 14 has an annular sealing part 15 similar to the sealing ring 6 of the prior art. The sealing member 14 further comprises a protective part 16 comprising a cylindrical part 17 and an upstream end forming an annular hook 18. The annular hook 18 has a truncated conical part 18*a* which rests on the truncated conical surface 11 of the recessed area 10 of the upstream end of the centering part 4. The truncated conical part 18*a* is connected to the cylindrical part 17 by a rounded annular connecting area 19 with a radially outer convex surface. The radius of curvature of said connecting area 19 is for example between 0.5 and 3 times the diameter of said cylindrical part, e.g. between 0.05 and 2 mm.

The hook 18 thus enables the sealing member 14 to be held in axial and radial position. The hook is used, among other things, to press the sealing member 14 against the centering part 3 so that no air can pass between these elements. In addition, as the thickness of the cylindrical part 17 is relatively small, e.g. less than 3 mm, it can be easily pressed by centrifugal force, so that an effective seal can be achieved between the sealing unit 14 and the low-pressure turbine shaft 2 at low speed.

It should also be noted that the larger diameter of the outer surface 20 of the downstream area of the centering part 4 is more reliable than the diameter of the cylindrical part 17 of the sealing member 14.

The sealing member 14 is made in one piece, preferably of a graphite-like material.

When fitting the vent tube 1 into the low-pressure turbine shaft 2, the downstream part of the vent tube 1 is fitted in the downstream direction so that the protective part 16 of the sealing member 14 is inserted first into the shaft 2. In this way, only the sealing member 14 comes into contact with the inner surface 7 of the low-pressure turbine shaft 2. This makes it possible to reduce or avoid damage to said inner surface 7.

Figure 5:
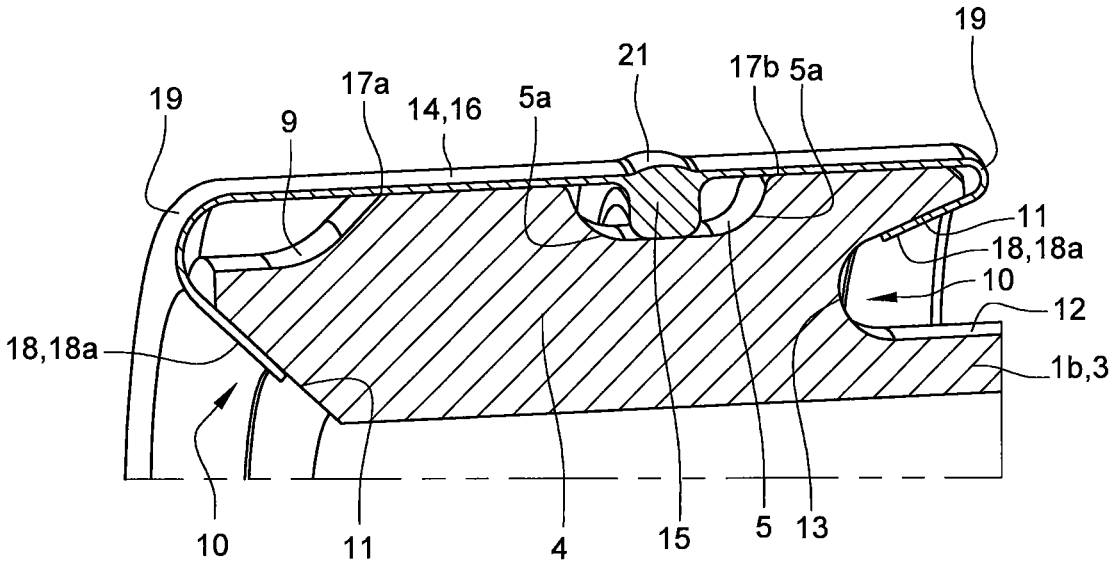
FIG. 5 is a view corresponding to FIG. 3, illustrating another embodiment of the invention.

FIG. 5 shows a second embodiment of the invention, which differs from the one shown in FIGS. 3 and 4 in that the sealing member 14 comprises an axially central annular sealing part 15, on either side of which an upstream cylindrical part 17*a* and a downstream cylindrical part 17*b* extend. Each cylindrical part is connected to an annular hook, 18, by means of a connecting part, 19. The radius of curvature of the upstream connecting part 19 is larger than the radius of curvature of the downstream connecting part 19.

The frustoconical surfaces 18*a* of the hooks 18 face away from each other so that they rest on the frustoconical surfaces 11 of the centering parts 4.

The radial and axial holding of the sealing member 14 on the corresponding centering part 4 is further improved by two opposing hooks 18.

In this embodiment too an annular bead 21 extends radially outwards beyond the diameter of the cylindrical parts 17*a*, 17*b*. Such a bead 21 can also be formed on a sealing member 14 according to the first embodiment. Such a bead 21 or such an oversize ensures an absolute sealing between the vent tube 1 and the low-pressure turbine shaft 2, especially in the case of a turbomachine start-up. For example, the oversize formed by such a bead is at least 1 mm thick.

Figure 6:
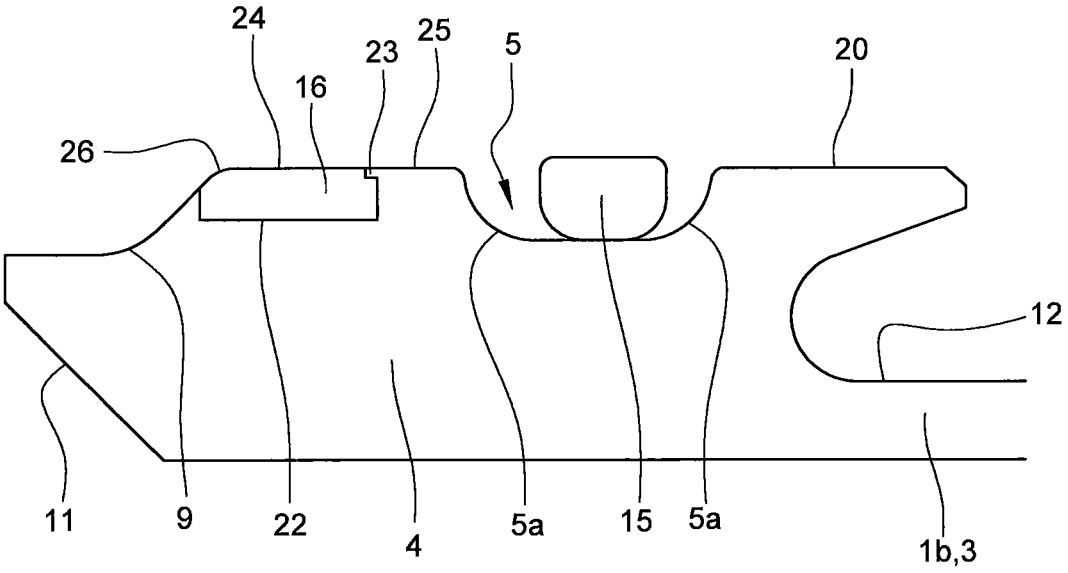
FIG. 6 is a cross-sectional axial view of a portion of an assembly according to still another embodiment of the invention.
Figure 7:
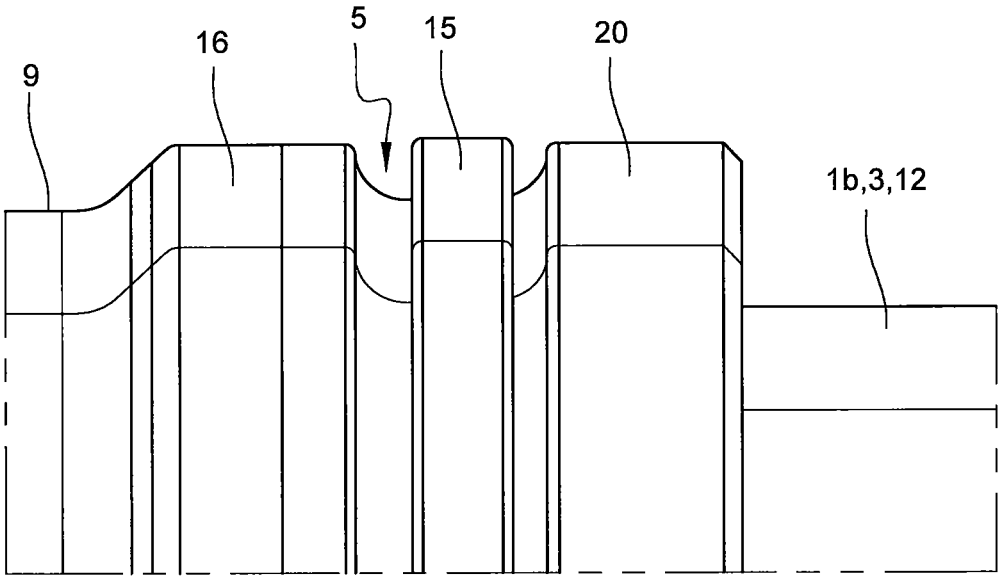
FIG. 7 is a side view illustrating a part of the assembly of FIG. 6.

FIGS. 6 and 7 represent an assembly in accordance with a third embodiment of the invention, in which the sealing part 15 is formed by an annular seal, the protective part being formed by a ring 16 housed in a correspondingly shaped housing 22 in the upstream area of the centering part 4. The housing 22 is located upstream of the groove 5 here, taking into account the direction of insertion of the part 1*b* of the tube 1 into the low-pressure turbine shaft 2. The housing 22 has a radially outer shoulder 23 to ensure that the ring 16 is held in position in the housing 22. The radially outer shape of the ring 16 reproduces the geometry of the centering part 4. In particular, the radially outer surface 24 of the ring 16 is cylindrical and extends in the extension of the radially outer cylindrical surface 25 of the upstream area of the centering part 4. The upstream end of the ring 24 has a rounded portion 26 extending in line with the radially outer surface of the recess 9. The ring 16 can be made of a material with a higher hardness than the material used for the seal 15. For example, the ring 16 is made of a Teflon type material, the seal 15 is made of a graphite type material. The sealing element 14 is thus made up of two parts, i.e. the ring 16 and the seal 15.

As before, the presence of the protective part 16 reduces or prevents damage to the inner surface of the low-pressure turbine shaft 2 when fitting the vent tube 1 into said shaft 2.

The invention claimed is:

1. An assembly comprising a vent tube intended to be mounted inside a turbine shaft of a turbomachine, the vent tube comprising a radially inner annular part from which at least one annular centering part extends radially outwards, said centering part comprising a groove formed in the centering part, wherein the assembly comprises a sealing member comprising a sealing part mounted in the groove of the centering part, the sealing part being configured to bear sealingly against an inner surface of the turbine shaft, the sealing member further comprising a protective part covering at least one region of the centering part located upstream and/or downstream of the groove, the protective part and the sealing part being formed in one piece.

2. The assembly of claim 1, wherein the sealing member comprises an upstream protective part covering an area of the centering part located upstream of the groove and a downstream protective part covering an area of the centering part located downstream of the groove.

3. The assembly of claim 1, wherein the protective part of the sealing member comprises an upstream end and/or a downstream end comprising at least one hook which engages in a recessed area of the upstream end and/or in a recessed area of the downstream end of the centering part.

4. The assembly of claim 3, wherein the protective part of the sealing member comprises a cylindrical part connecting the sealing part to the end equipped with the hook.

5. The assembly of claim 4, wherein the sealing part has an annular bead projecting radially outwards from the cylindrical part.

6. The assembly of claim 4, wherein the connecting area between the hook and the cylindrical part has a rounded shape.

7. The assembly of claim 3, wherein the hook is annular and comprises a frustoconical part capable of bearing against a frustoconical surface of the recessed area.

8. A turbomachine comprising a turbine shaft and the assembly of claim 1, mounted in the turbine shaft.

* * * * *